US005400848A

United States Patent [19]

Gainer

[11] Patent Number: 5,400,848

[45] Date of Patent: Mar. 28, 1995

[54] DECORATIVE SHADES

[76] Inventor: Janet R. Gainer, 48 Eagle Crest Dr., No. 5a, Lake Oswego, Oreg. 97035

[21] Appl. No.: 134,552

[22] Filed: Oct. 7, 1993

[51] Int. Cl.[6] ..... A47G 5/02

[52] U.S. Cl. ..... 160/238; 160/121.1; 160/DIG. 7

[58] Field of Search ..... 160/238, 120, 236, 121.1, 160/DIG. 7; 428/354, 542.2, 18; 434/79, 95

[56] References Cited

U.S. PATENT DOCUMENTS

| | | | |
|---|---|---|---|
| 1,395,575 | 11/1921 | Jarvis | 428/18 X |
| 3,205,118 | 9/1965 | Guffan | 160/238 |
| 4,289,804 | 4/1981 | Samuels | 428/542.2 X |
| 4,495,230 | 1/1985 | Ellwein | 428/95 X |
| 4,564,406 | 1/1986 | Binks | 434/95 X |

*Primary Examiner*—Blair M. Johnson
*Attorney, Agent, or Firm*—Robert L. Harrington

[57] ABSTRACT

A decorative window shade for a window opening and the like constructed of multiple layers of materials. A base layer covers the total area of the shade. Subsequent layers having defined patterns are applied in layers. A portion of the base layer may remain uncovered to provide an area having a single thickness of material, the subsequent layers may cover only a portion of the base layer to provide an area having a two layer thickness or may be overlaid on a previous patterned layer to provide an area having a multiple layer thickness. The layered material thus provides areas of varying thickness which provided for areas varying in translucence. In addition the patterned arrangement of the layers of material provide a shade that is aesthetically appealing.

8 Claims, 1 Drawing Sheet

DECORATIVE SHADES

FIELD OF THE INVENTION

This invention relates to shades, e.g., used as window coverings and more particularly relates to decorative shades that have patterned areas of varying transparency.

BACKGROUND OF THE INVENTION

Window shades are most often thought of as a means of providing privacy. Shades are drawn when it is desired to prevent others from visually seeing into a room. Shades are also utilized to shut out light transmitted through the window, either from natural sunlight or from man made light sources. One type of shade is thus made from an opaque material that is drawn when total privacy or elimination of light is desired.

Dwellers who reside in buildings that are built in close proximity to each other often desire a shade or window covering that will afford privacy yet will not block or prevent all light from entering a room during daylight hours. Such a dweller often desires that the shade or window covering be aesthetically appealing as well. It is an object of this invention to provide a window shade that is translucent but not transparent so as to provide privacy and light but also utilizes the light transmitting properties of the shade material to produce the desired aesthetics.

BRIEF SUMMARY OF THE INVENTION

A preferred embodiment of the present invention is a roll up type window shade. The shade has at least one base layer of diaphanous (gauzy) type material that covers the total area of the shade. The material is of the type that is quite sheer and readily transmits light but without allowing objects to be seen through the material. Additional layers of the same or similar material having a determined pattern are affixed in layers onto the base layer of material. The second layer of patterned material is affixed onto the first (base) layer, the third patterned material is affixed to the second layer and so forth until all of the layers are completed. The material of the second and third layers is of the type that will adhere to another by applying pressure and heat, such as by ironing.

The material layered in a patterned arrangement will alter the light transmission. The portion of the shade that has only one layer (the base layer) will permit light to transmit rather readily, while a portion of the shade that has two layers will be less translucent, that is less light will be transmitted and therefore more difficult to see through. The shade is constructed of the number of layers required to provide the desired patterned effect and to provide the desired privacy and the amount of light desired through the shade.

The patterned layers provide contrast, particularly when light is cast upon the shade. A single layer will appear light, two layers will appear darker than the single layer, three layers will appear darker than two layers and so on. The shade thus may be constructed to provide the desired privacy and to provide an aesthetically appealing pattern. It is contemplated that colored layers may be incorporated to provide still further variations.

Refer now to the drawings and the detailed description for a complete understanding of the invention.

DESCRIPTION OF THE PREFERRED EMBODIMENT

Figure 1:
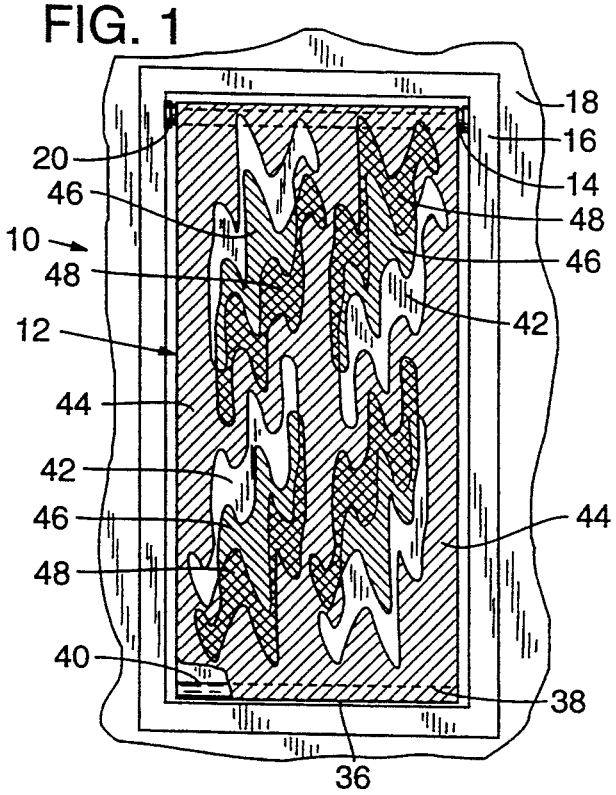
FIG. 1 is a view of a roll up shade of the present invention shown mounted in a window opening.

Refer now to FIG. 1 of the drawings which illustrates a preferred embodiment of a window shade 10 of the present invention. In this embodiment the shade 10 is a roll up type shade with the shade material 12 being a composite of several layers, the shade material 12 being fitted in a conventional manner to a roller 14 of known design and construction. The roller 14 of the shade 10 is rotatably mounted in a window opening 16 of a room 18 on mounting brackets 20. The shade material 12 is dimensioned to be of a size to cover the window opening 16. The roller 14 is spring biased to rotate (roll) in one direction to roll the shade material 12 onto the roller when it is desired to elevate (open) the shade and the shade is lowered (closed) by simply pulling the shade material 12 of the shade 10 downward, thus rotating the roller 14 in the opposite direction to roll the shade material 12 off the roller 14. The roller 14 includes a known latching mechanism to latch the roller in a fixed rotative position enabling a user to adjust the shade to any desired position between the open and closed positions. The lower end 36 of the shade material 12 of the shade 10 has a pocket 38 formed as by hemming for the insertion of a conventional slat 40.

Typically a shade such as the shade 10 of the present invention is fitted to a window opening 16 of a room 18 or the like to provide privacy and/or limit the amount of light transmitted through the window opening 16 such as sunlight or other sources. The user, for privacy, wants the interior of the room 18 blocked from view from an individual or individuals on the outside. Often, however, the user wants to screen, that is permit a limited amount of light to enter the room, particularly during daylight hours. In addition, when the shade is drawn (that is closed) the user desires the exposed shade to be aesthetically appealing. The shade 10 of the present invention affords the desired privacy, will permit a certain amount of light to be transmitted, and is constructed to be aesthetically appealing.

Figure 3:
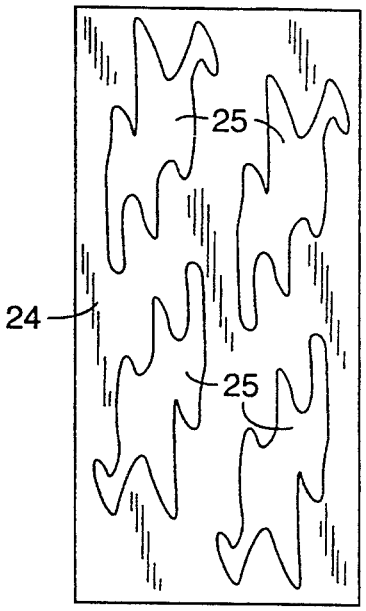
FIG. 3 is a view of one of the layers of material utilized in the shade of FIG. 1; and, FIG. 4 is a view of another shade of the present invention.
Figure 2:
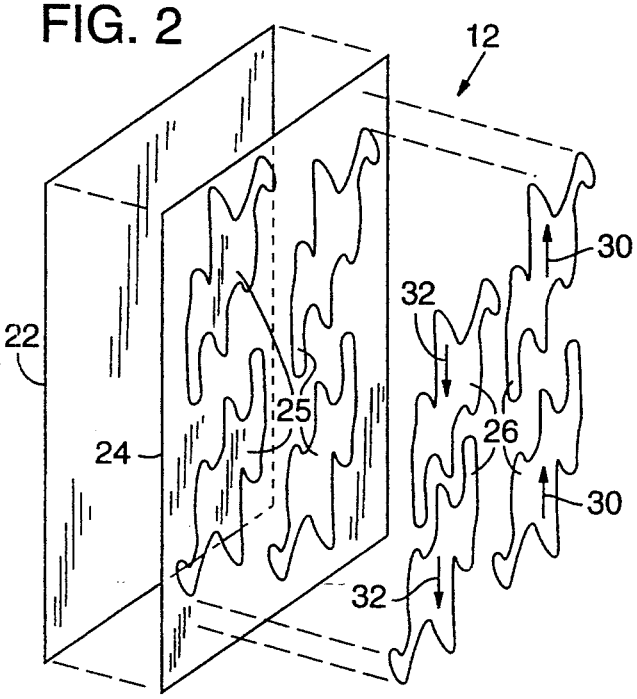
FIG. 2 is an exploded view of the shade of FIG. 1 to illustrate the method of producing the shade.

Refer now to FIG. 2 of the drawings which illustrates in exploded view one method of constructing the shade 10 of the present invention. The shade material 12 of the shade 10 has multiple layers of material fitted one on top of another. For reference the base layer, which covers the total area of the shade 10 will be referred to as the base 22. The second layer which overlays the base 22 will be referred to as the remnant 24 and the third layer which overlays the base 22 and the remnant 24 will be referred to as the pattern 26. In this embodiment the patterns 26 are cut out and removed from the layer that is remnant 24, the removal of the patterns 26 producing cut out areas 25 as shown in FIG. 3. Thus there is no waste of material. The layer 24 is referred to as a remnant since it is the portion that remains after the patterns 26 have been cut out and removed.

The material of base 22 is preferably a thin gauzy type of material that will readily permit the transmission of light. The remnant 24 and thus the pattern 26 produced from the remnant 24 are preferably of a similar but somewhat thicker gauzy type material that is treated on one side with a known adhesive material. That is, one side is coated with adhesive that is dormant until heated. Laying the coated side against another material, e.g., base 22, and applying heat and pressure (e.g., with a conventional iron) will cause the remnant to bond to the other material. The base 22 is preferably of an untreated material since one side of the base 22 is totally exposed when the shade is drawn (closed) and a portion of the opposite side of the base 22 may be partially exposed by the patterned effect of the layered construction which will be explained.

In this embodiment the base 22 and the remnant 24 are of the same length and width. The remnant 24 is overlaid on the base 22 and is affixed by applying pressure and heat as by ironing. The patterns 26 are similarly affixed, the patterns 26 being overlaid on layered material of the base 22 and the remnant 24. The patterns are however shifted from their original position in reference to the remnant 24. Referring to FIG. 2, the patterns 26 on the right (as viewed in the figure) are shifted upward as indicated by arrows 30 and the patterns 26 on the left are shifted downward as indicated by arrows 32. The patterns 26 thus do not fit or overlay the remnant 24 in their original cut out position but are offset as illustrated in FIG. 1.

The resulting overlaying patterned arrangement is as shown in FIG. 1. The clear (unshaded) portion 42 of FIG. 1 designates a single layer of material, the layer being the base 22. The cross hatching portions 44, 46 (single diagonal line in opposite directions) designates a double layer of material, the layers being either the layering of the base 22 and the remnant 24 (portion 44) or the base 22 and the pattern 26 (portion 46). The double cross hatching (orthogonal diagonal lines) designates a triple layering portion 48, the layers being the base 22, the remnant 24 and the pattern 26.

The shade of FIG. 1 thus has a defined pattern provided by the positioning of patterns 26 and the overlaying arrangement of the layers 22, 24, and 26. The layering of the materials provides areas of varying translucence. The variation in thickness of the shade material 12 over the different portions, that is whether the portion of the material 12 has a single thickness, a double thickness or a triple thickness provides the variation in the translucence. The variation in translucence also provides a simulated depth dimension contrast, particularly when light is cast upon the shade. A single layer of material will appear light, a double layer of material will appear darker than the single layer and a triple layer will appear darker than the double layer and so forth.

Figure 4:
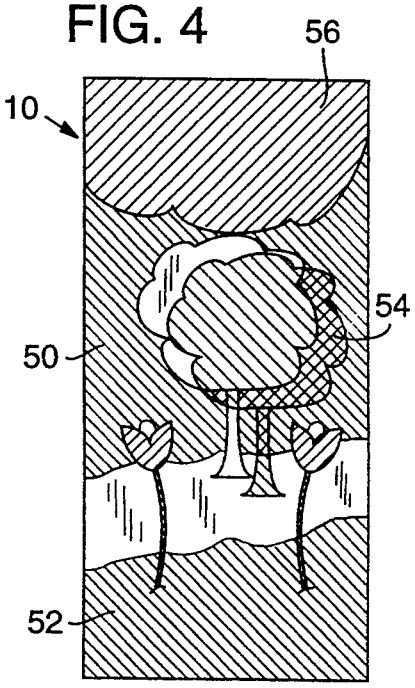

The preferred embodiment described and illustrated utilizes two pieces of material to construct a shade having areas with a three layer thickness. While the preferred embodiment utilized all of the material by shifting the patterns 26 on the remnant 24, it is apparent that other arrangements and variations in the configurations of the layers is unlimited. Patterns of any configuration may be applied to the base 22 either in single layers or in multiple layers of choice. One variation is illustrated in FIG. 4 to illustrate that colored layers may be utilized to provide added variations. As an example, 50 may be blue in color to represent the sky, 52 may be green to represent grass, 54 may be a combination of cut outs and patterns to represent trees and providing a depth dimension thereto, 56 may be off white or grayish in color to represent clouds and so forth.

A significant factor that is provided by the different layers of material (and thus the different levels of translucency) is the visual depth dimension that is added.

Those skilled in the art will recognize that variations and modifications may be made without departing from the true scope and spirit of the invention. The term shades as used herein encompasses hangings, screens and the like which are strategically placed to interrupt light transmission and thereby generate the varying translucence as described. Whereas the three layers are considered minimal to achieve the desired effect, additional layers may be added without departing from the invention. The invention is therefore not to be limited to the embodiments described and illustrated, but is to be determined from the appended claims.

What is claimed is:

1. A decorative non-transparent shade that screens but does not prohibit light transmission, said shade comprising:

a first layer of non-transparent, translucent material, a second layer of non-transparent, translucent material, said second layer overlapping said first layer in part only to form areas of single and double thicknesses;

a third layer of non-transparent, translucent material, said third layer overlapping said double thickness area in part only to provide a triple layer thickness and in combination providing multiple window shade portions of first layer thickness and not second and third layer thickness, first and second layer thickness and not third layer thickness, and first, second and third layer thickness; and said shade mountable relative to a light source and said single layer thickness, said double layer thickness and said triple layer thickness all transmitting light therethrough from either side of said shade and with varying levels of translucence.

2. A decorative shade as defined in claim 1 wherein the second and third layers are provided with a heat and pressure sensitive adhesive coating, and said second and third layers are bonded together and to said first layer through the application of heat and pressure applied to the overlaying layers.

3. A decorative shade as defined in claim 1, wherein selective ones of the layers are colored.

4. A decorative shade as defined in claim 1 wherein said shade is utilized as a window shade and mounted on a rotatable roller mounted in a window, said shade being rollable and unrollable from said roller to alternately remove and place said shade over said window.

5. A decorative shade as defined in claim 1 wherein said third layer also overlaps said single thickness area and not said double thickness area to provide a further level of translucence.

6. A method of producing a decorative non-transparent shade that screens but does not prohibit light transmission, said method comprising:

providing a base layer of translucent material having dimensions that define a shade area, applying a first over-layer of translucent material to said base layer in selected portions of said shade area and providing thereby non-selected portions of base layer only in said shade area, and applying a second over-layer of translucent material to said first over-layer in part only in said selected portions of said shade area to produce thereby translucent shade portions of single thickness base layer, translucent shade portions of double thickness base layer and first over-layer, and translucent shade portions of triple thickness including base layer, over-layer and second over-layer, the steps of application of said first layer to said base and said second layer to said first layer being reversible in sequence; and mounting said shade relative to a light source for transmitting light through the translucent shade portions from either side of said shade, said shade having varying levels of translucence.

7. A method as defined in claim 6 which includes applying said second over-layer also to said base layer only in said non-selected areas of said shade area to produce thereby a further translucent shade portion of double thickness and a further level of translucence of said shade.

8. A method of producing a decorative non-transparent shade that screens but does not prohibit light transmission, said method comprising:

providing a first layer of translucent material having length and width dimension defining an area that is a base layer, providing a second layer of translucent material, said second layer having an adhesive coating on one side that is heat and pressure sensitive to effect bonding thereof to an interfacing material;

removing portions of said second layer to provide a remnant layer and pattern layers, each having a bonding side;

bonding said remnant layer to said first layer producing thereby single and double thickness portions within the area of said base layer, and bonding said pattern layers to said first and second layers to produce portions within the area that are single thickness of base layer only, double thickness of base and remnant layers only, double thickness of base and pattern layers only and triple thickness of base, remnant and pattern layers only.

* * * * *